US009385450B2

(12) United States Patent
Wu et al.

(10) Patent No.: US 9,385,450 B2
(45) Date of Patent: Jul. 5, 2016

(54) CABLE CONNECTOR ASSEMBLY

(71) Applicant: HON HAI PRECISION INDUSTRY CO., LTD., New Taipei (TW)

(72) Inventors: Jerry Wu, Irvine, CA (US); Jun Chen, Kunshan (CN); Feng-Jun Qi, Hefei (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/447,521

(22) Filed: Jul. 30, 2014

(65) Prior Publication Data

US 2015/0037986 A1 Feb. 5, 2015

(30) Foreign Application Priority Data

Jul. 30, 2013 (CN) ..... 2013 1 03234321

(51) Int. Cl.

| | |
|---|---|
| ***H01R 12/52*** | (2011.01) |
| ***H01R 12/62*** | (2011.01) |
| ***H01R 13/516*** | (2006.01) |
| ***H01R 27/02*** | (2006.01) |
| ***H01R 31/02*** | (2006.01) |
| *H01R 13/506* | (2006.01) |
| *H01R 13/6581* | (2011.01) |

(52) U.S. Cl.

CPC ..... *H01R 12/52* (2013.01); *H01R 12/62* (2013.01); *H01R 13/516* (2013.01); *H01R 27/02* (2013.01); *H01R 31/02* (2013.01); *H01R 13/506* (2013.01); *H01R 13/6581* (2013.01); *H01R 2201/06* (2013.01)

(58) Field of Classification Search

USPC ..... 439/578, 871, 607.41, 607.46, 540.1, 439/493, 496

See application file for complete search history.

(56) References Cited

U.S. PATENT DOCUMENTS

| | | | | |
|---|---|---|---|---|
| 5,496,970 | A * | 3/1996 | Spencer | H01R 12/62 174/117 F |
| 6,017,222 | A * | 1/2000 | Kao | H01R 12/613 439/493 |
| 6,123,588 | A * | 9/2000 | Johnston | H01R 12/62 439/493 |
| 6,139,357 | A * | 10/2000 | Shih | H01R 12/62 439/493 |
| 6,761,584 | B2 * | 7/2004 | Li | H01R 12/7076 439/540.1 |
| 7,303,438 | B2 * | 12/2007 | Dawiedczyk | H01R 12/7005 439/358 |
| 7,509,508 | B2 * | 3/2009 | Chen | G06F 13/409 439/492 |
| 7,690,930 | B2 * | 4/2010 | Chen | H01R 9/038 439/76.1 |
| 8,118,615 | B2 * | 2/2012 | Peng | H01R 13/514 439/607.27 |
| 8,133,071 | B2 * | 3/2012 | Huang | H01R 12/778 439/499 |
| 8,221,160 | B2 * | 7/2012 | Liu | H01R 13/6658 439/540.1 |
| 8,430,692 | B2 * | 4/2013 | Peng | H01R 13/518 439/607.46 |
| 2010/0075544 | A1 * | 3/2010 | Liu | H01R 13/504 439/701 |

FOREIGN PATENT DOCUMENTS

| | | |
|---|---|---|
| CN | 2812077 | 8/2006 |

* cited by examiner

*Primary Examiner* — Alexander Gilman
(74) *Attorney, Agent, or Firm* — Ming Chieh Chang; Wei Te Chung

(57) ABSTRACT

A cable connector assembly comprises: a first connector module comprising an insulative housing with a plurality of receiving rooms, a plurality of first connectors respectively received into the receiving rooms, a first PCB electrically connected to the plurality of first connectors and a metallic shell enclosing the insulative housing; and a second connector module comprising a second PCB formed therein; a flat wire electrically connecting to the first connector module and the second connector module. One end of the flat wire is electrically connected to the first PCB, and the other end of the flat wire is electrically connected to the second PCB.

1 Claim, 6 Drawing Sheets

CABLE CONNECTOR ASSEMBLY

BACKGROUND OF THE INVENTION

1. Field of the Invention

The present invention relates to a cable connector assembly, and more particularly to a cable connector assembly used in a computer case.

2. Description of the Related Art

With the development trend of miniaturization and multifunction of the electric apparatus, the electrical connector formed in the electric apparatus should not only have a good signal transmission, but also have characteristics of miniaturization, simple and easy to use. At present, the interface of USB and Audio Jack have become common I/O ports, and are usually installed on a panel of the computer case to connect the computer with the peripheral equipment.

Generally, the USB and Audio Jack connector are together formed on one side of the cable connector assembly and installed on the panel of the computer case. And the front end of the USB and Audio Jack connectors are located outside of the panel of the computer case. And, a number of electrical connectors are formed on another side of the cable connector assembly and electrically connected to the corresponding board end connectors on the printed circuit board in the computer case. Currently, the existing cable connector assembly usually has several round wires and a plurality of connectors formed at both sides thereof. To avoid several round wires twisted together, a wire management is needed to well arrange the round wires. So the cable connector assembly will have high manufacturing cost due to additional wire management. And, the several round wires will occupy larger room in the computer case. Meanwhile, the cable connector assembly has lower soldering efficiency since several round wires should be welded to the electrical connector by one to one correspondence.

SUMMARY OF THE INVENTION

Accordingly, an object of the present invention is to provide a cable connector assembly which can realize fast welding process and with a lower manufacturing cost.

In order to achieve the object set forth, a cable connector assembly comprises: a first connector module comprising an insulative housing with a plurality of receiving rooms, a plurality of first connectors respectively received into the receiving rooms, a first PCB electrically connected to the plurality of first connectors and a metallic shell enclosing the insulative housing; and a second connector module comprising a second PCB formed therein; a flat wire electrically connecting to the first connector module and the second connector module. One end of the flat wire is electrically connected to the first PCB, and the other end of the flat wire is electrically connected to the second PCB.

DESCRIPTION OF PREFERRED EMBODIMENT

Figure 1:
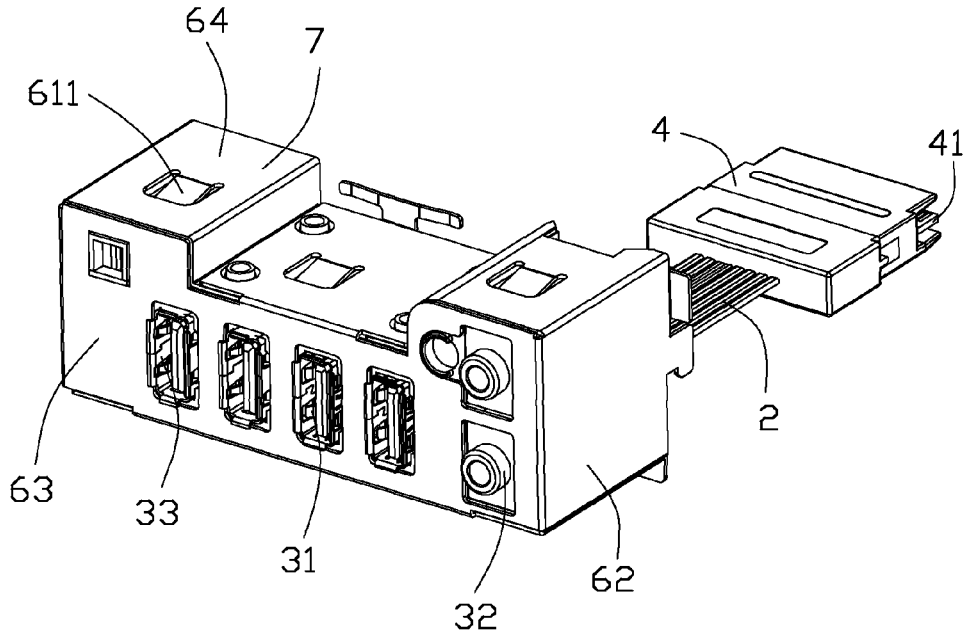
FIG. 1 is an assembled, perspective view of a cable connector assembly in accordance with the present invention.

Reference will now be made to the drawings to describe the present invention in detail.

Referring to FIGS. 1 to 6, a cable connector assembly according to the present invention includes a first connector module 7 installed on a panel of a computer case, a second connector module 4 opposite to the first connector module 7 and a flat wire 2 electrically and mechanically connecting the first connector module 7 and the second connector module 4 electrically. Actually, the first connector module 7 is a front I/O module.

Referring to FIGS. 1 to 4, the first connector module 7 includes an insulative housing 5 having a number of receiving rooms arranged along a transversal direction, a plurality of first connectors 3 respectively accommodated into the corresponding receiving rooms, a first PCB 1 electrically connected to the plurality of first connectors 3 electrically and a metallic shell 6 shielding the insulative housing 5.

Figure 3:
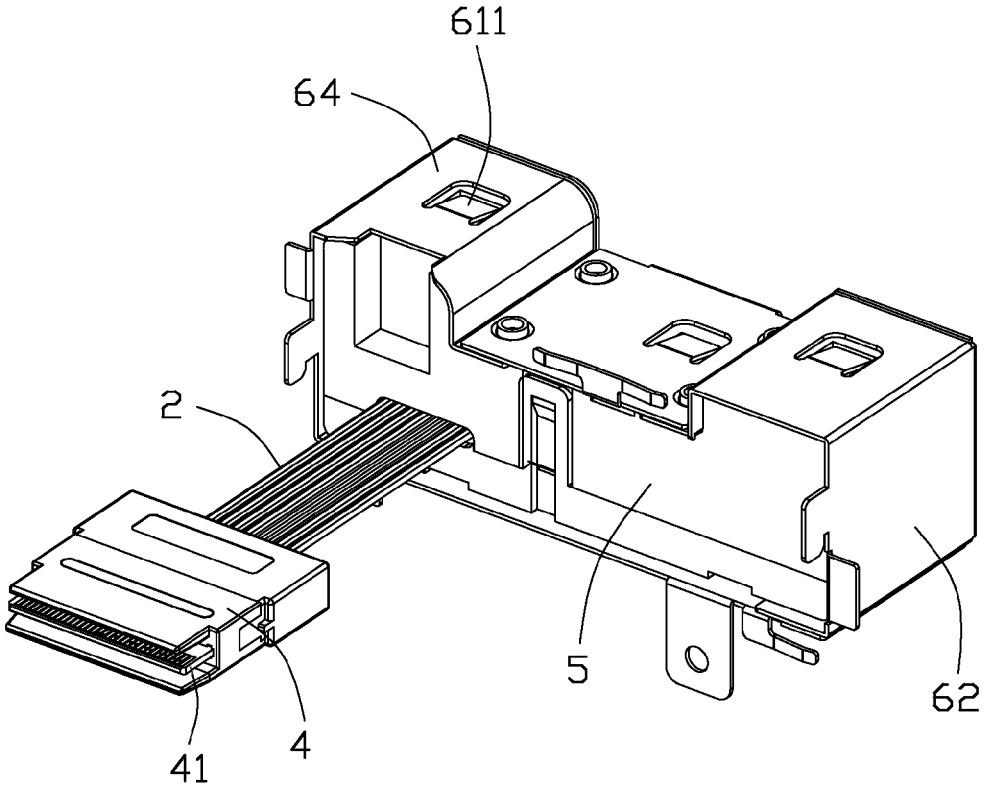
FIG. 3 is an another assembled, perspective view of the cable connector assembly as shown in FIG. 1.
Figure 4:
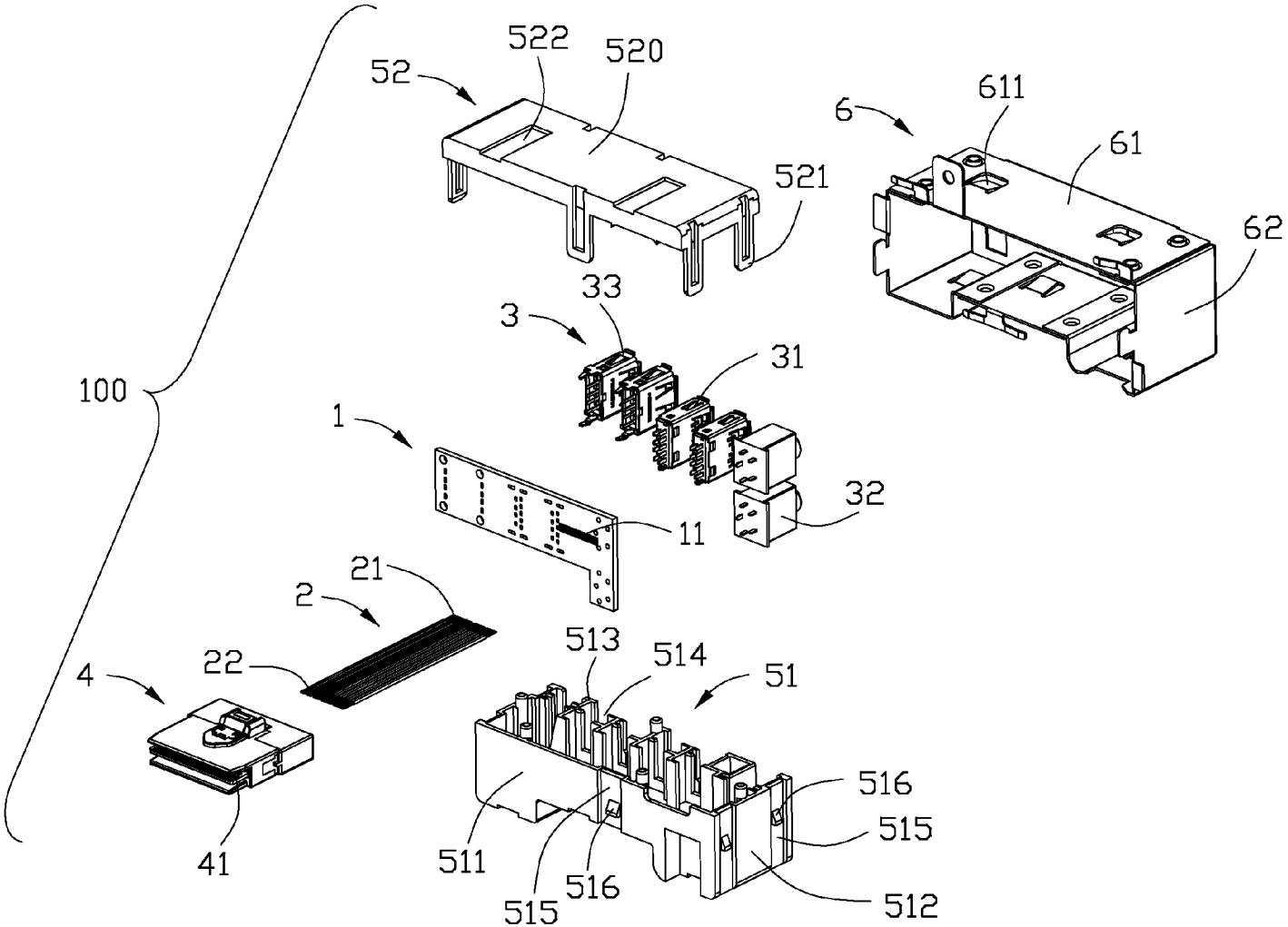
FIG. 4 is an another exploded, perspective view of a cable connector assembly as shown in FIG. 2.
Figure 5:
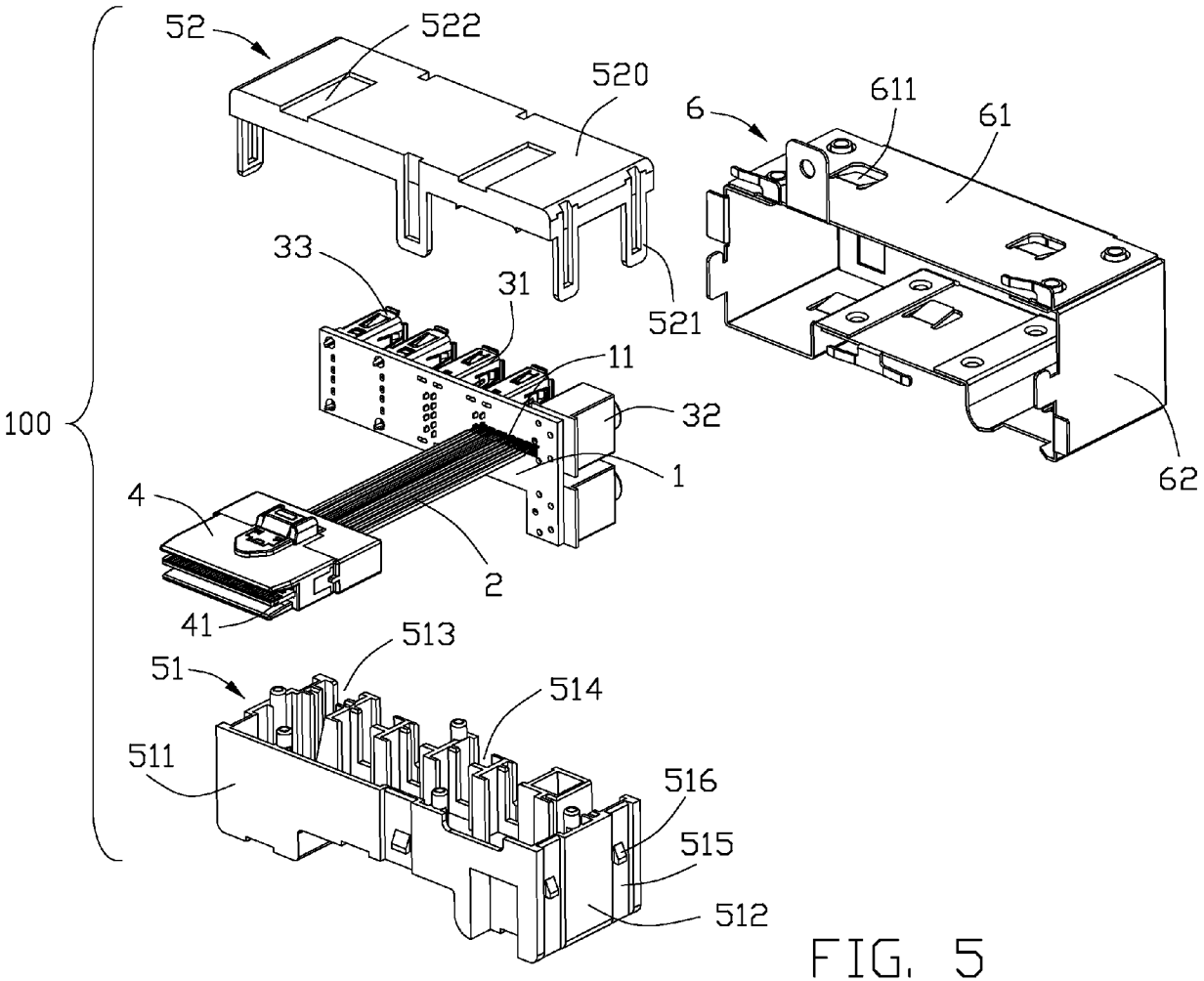
FIG. 5 is an another partially assembled view of the cable connector assembly as shown in FIG. 4.
Figure 6:
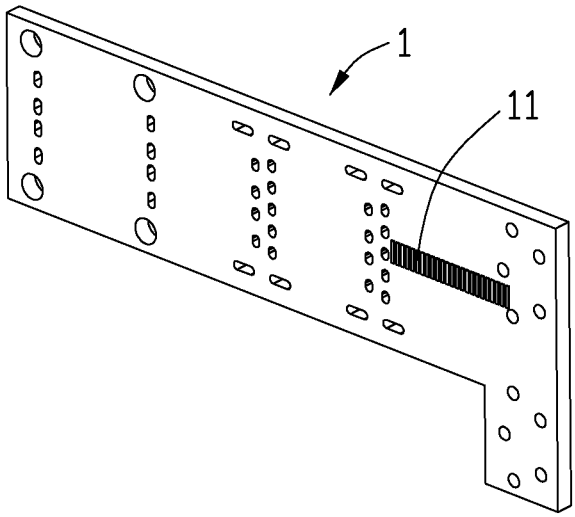
FIG. 6 is a printed circuit board of the cable connector assembly as shown in FIG. 1.

Referring to FIGS. 3 to 5, the insulative housing 5 comprises a first cover 51 and a second cover 52 assembled with the first cover 51. The first cover 51 comprises a rear wall 511, a pair of lateral walls 512 and a top wall 517. There are guiding grooves 515 formed on the rear wall 511 and the lateral wall 512. The first cover 51 defines a plurality of convex blocks 516 respectively formed in the corresponding guiding grooves 515. Each of the convex blocks 516 is located on a bottom surface of the guiding groove 515. There are two retaining grooves 5171 located at two sides of a top surface of the top wall 517 and a first recess recessed downwardly in a middle area of the top surface of the top wall 517. The top wall 517 has a number of partitions 513 extending downwardly. A receiving cavity 514 is formed between every two adjacent partitions 513 to receive a first connector 3. The second cover 52 comprises a bottom wall 520, a peripheral wall extends upward from a top surface of the bottom walls 520. A number of latching member 521 extends upward from the peripheral wall. The latching members 521 are accommodated into the guiding groove 515 of the first cover 51 and latched with the corresponding convex block 516 located in the guiding groove 515. There are two retaining grooves 522 located at two sides of bottom surface of the bottom wall 520 of the second cover 52.

Figure 2:
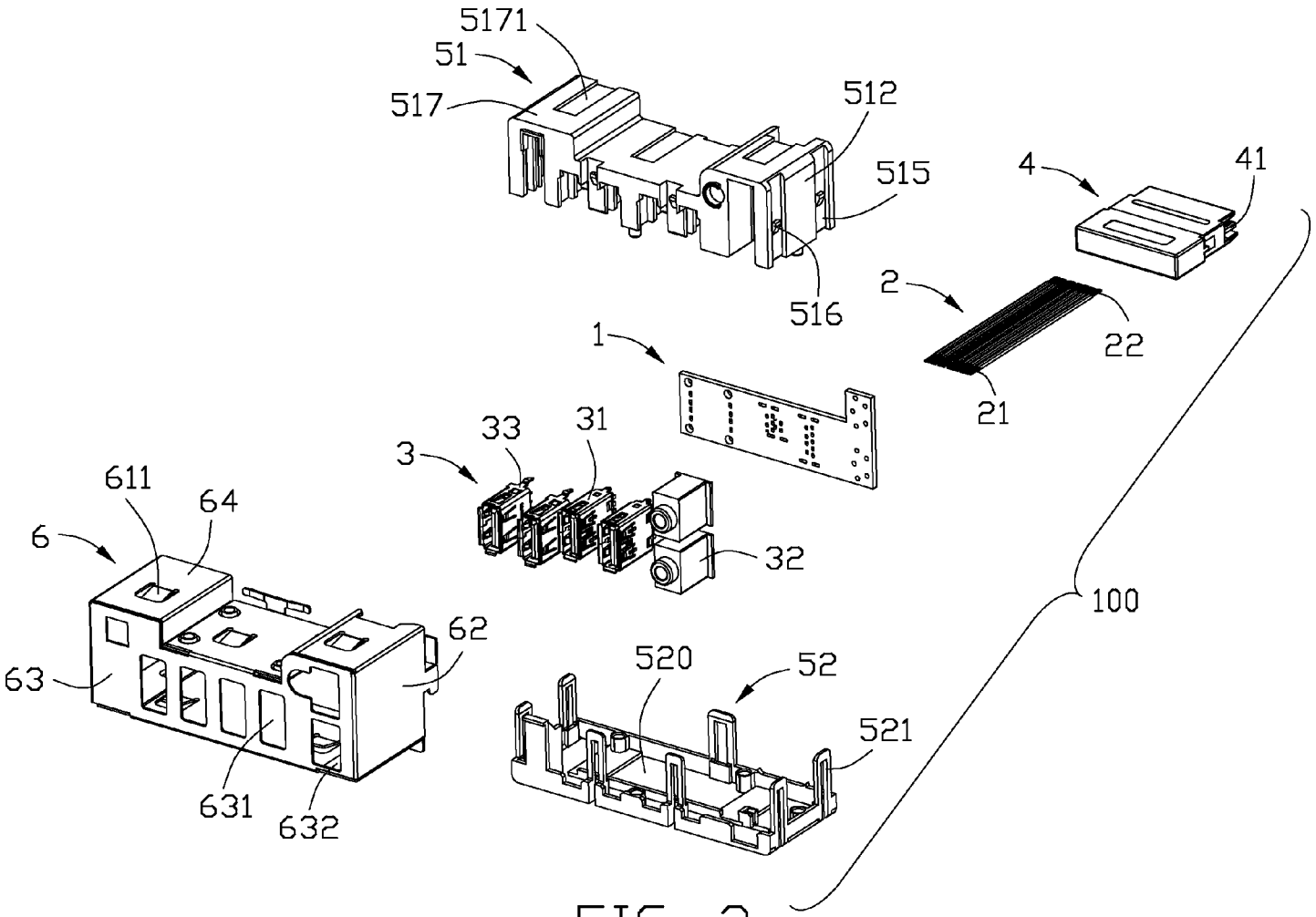
FIG. 2 is an exploded, perspective view of the cable connector assembly as shown in FIG. 1.

Referring to FIG. 2, the plurality of first connectors 3 includes two USB 2.0 connectors 33, two USB 3.0 connectors 31 and two audio jack connectors 32. The two USB 2.0 connectors 33 and two USB 3.0 connectors 31 are arranged along a transversal direction. The two audio jack connectors 32 are stacked with each other and located on the right side of the two USB 2.0 connectors 33 and two USB 3.0 connectors 31.

Referring to FIGS. 2 to 6, the first PCB 1 is approximately in a L shape. A number of the first connectors 3 are welded to the first PCB 1. The first PCB 1 has a number of conductive pads 11 formed on rear surface thereof and arranged in horizontal direction.

Referring to FIGS. 1 to 5, the metallic shell 6 is structured in a rectangular shape and comprises a bottom wall 61, two lateral walls 62, a front wall 63 and a top wall 64. The bottom wall 61 and the top wall 64 respectively has a number of elastic tabs 611 bent inwardly to engage with the retaining grooves 522, 5171 of the insulative housing 5. The front wall 63 defines four rectangular holes 631 paralleled with each other and arranged along a transversal direction and two holes 632 arranged along a vertical direction to allow the front end of the two USB 2.0 connectors 33, two USB 3.0 connectors 31 and the two audio jack connectors 32 to pass through the metallic shell 6 in a rear-to-front direction. The top wall 64 further defines a second recess formed on a middle area thereof The top wall 64 tightly attaches to the top surface of the insulative housing.

Referring to FIGS. 1 to 5, the second connector module 4 is a Mini SAS connector having a second PCB 41 formed therein. The impedance of the second PCB 41 is 98 ohm. A plurality of rear conductors 22 of the flat wire 2 are welded to the second PCB 41 of the second connector module 4 to realize the electrical connection therebetween.

Referring to FIGS. 2 to 4, the flat wire 2 is located in a flat plane. Two portions of insulative jacket of the flat wire 2 are peeled to make a plurality of front conductors 21 and rear conductors 22 respectively exposed out of the insulative jacket. The plurality of front conductors 21 are welded to the corresponding conductive pads 11 on the rear surface of the first PCB 1. The plurality of rear conductors 22 are welded to the second PCB 41 of the second connector module 4.

Referring to FIGS. 1 to 6, the cable connector assembly 100 according to the present invention can be assembled through following steps. Firstly, the two USB 2.0 connectors 33, the two USB 3.0 connectors 31 and the two audio jack connectors 32 are welded to the first PCB 1 Secondly, the plurality of front conductors 21 of the flat wire 2 are welded to the conductive pads 11 of the first PCB 1 of the first connector module 7 and the plurality of rear conductors 22 of the flat wire 2 are welded to the second PCB 41 of the second connector module 4. Thirdly, the plurality of first connectors 3 and the first PCB 1 are assembled into the first cover 51. The two USB 2.0 connectors 33 and the two USB 3.0 connectors 31 are arranged along the transversal direction and received into the receiving cavity 514 of the first cover 51. The two audio jack connectors 32 are arranged along a vertical direction received into the rest receiving cavities 514 of the first cover 51. Fourthly, the second cover 52 is assembled to the first cover 51. The plurality of latching members 521 of the second cover 52 are received into the corresponding guiding grooves 515 of the first cover 51 and latched to the corresponding convex blocks 516 formed in the guiding groove 515. Then the metallic shell 6 encloses the insulative housing 5 long a front-to-rear direction. The elastic tabs 611 formed on the top wall 64 of the metallic shell 6 are cooperated with the corresponding retaining grooves 5171, 522. At last, the plurality of rear conductors 22 of the flat wire 2 are welded to the second PCB 41 of the second connector module 4.

Through above assembling steps, the cable connector assembly 100 is finished. The cable connector assembly 100 according to the present invention comprises a second first connector module 4 only including a Mini SAS connector mated with a complementary connector (not shown) mounted on a PCB formed in the computer case. Meanwhile, the cable connector assembly 100 comprises a flat wire in stead of traditional round wires to avoid managing round wires. Actually, the cable connector assembly 100 has a lower manufacturing cost and with high assembling efficiency.

What is claimed is:

1. A cable connector assembly comprising:

an insulative housing including a first cover and a second cover assembled to each other along a vertical direction by means of latching members, a plurality of receiving cavities formed in the housing and spaced from each other in a transverse direction perpendicular to said vertical direction, each of said cavities communicating, via a corresponding front opening, with an exterior in a front-to-back direction perpendicular to both said vertical direction and said transverse direction;

a vertically standing printed circuit board;

a plurality of electrical connectors mounted to the printed circuit board in a perpendicular manner and received within the corresponding cavities, respectively, to communicate with the exterior via said openings;

the housing further forming a unitary elongated space uninterruptedly extending in the transverse direction and located behind the respective cavities to receive said printed circuit board therein, said housing further forming only one horizontal slot in a back face thereof;

the printed circuit board and the associated connectors being configured to be assembled into the housing only along the vertical direction in a protective manner; and only one flat cable extending through said only one slot and having one end electrically connected to the printed circuit board and the other end mechanically and electrically connected to an external connector;

wherein a middle one of said latching members is located on the back face and adjacent to the slot in the transverse direction;

wherein said middle one of the latching members is located at a middle region of the back face, and said only one horizontal slot is off set from said middle region in the transverse direction.

* * * * *